US005318114A

United States Patent [19]

Sasaki

[11] Patent Number: 5,318,114

[45] Date of Patent: Jun. 7, 1994

[54] MULTI-LAYERED TYPE HEAT EXCHANGER

[75] Inventor: Kenichi Sasaki, Isesaki, Japan

[73] Assignee: Sanden Corporation, Isesaki, Japan

[21] Appl. No.: 941,918

[22] Filed: Sep. 8, 1992

[30] Foreign Application Priority Data

Sep. 5, 1991 [JP] Japan ..... 3-252901

[51] Int. Cl.[5] ..... F28D 1/047

[52] U.S. Cl. ..... 165/176; 165/109.1; 165/177

[58] Field of Search ..... 165/109.1, 176, 177

[56] References Cited

U.S. PATENT DOCUMENTS

| | | | |
|---|---|---|---|
| 3,540,529 | 11/1970 | Unimo et al. | 165/134.1 |
| 3,746,525 | 7/1973 | Kasuga et al. | 165/176 X |
| 3,757,855 | 9/1973 | Kun et al. | 165/166 |
| 4,570,700 | 2/1986 | Ohara et al. | 165/134.1 |
| 4,663,812 | 5/1987 | Clausen | 165/176 X |
| 4,749,033 | 6/1988 | Clausen | 165/173 |
| 5,082,051 | 1/1992 | Ando | 165/110 |
| 5,088,193 | 2/1992 | Okada et al. | 29/890.043 |
| 5,099,576 | 3/1993 | Shinmura | 29/890.049 |
| 5,111,878 | 5/1992 | Kadle | 165/176 |
| 5,172,762 | 12/1992 | Shinmura et al. | 165/173 |

FOREIGN PATENT DOCUMENTS

| | | | |
|---|---|---|---|
| 3302150 | 7/1984 | Fed. Rep. of Germany | 165/176 |
| 3803599 | 8/1989 | Fed. Rep. of Germany | 165/176 |
| 2010517 | 2/1970 | France . | |
| 62-153685 | 7/1987 | Japan | 165/176 |
| 2166862A | 5/1986 | United Kingdom | 165/176 |

*Primary Examiner*—Allen J. Flanigan
*Attorney, Agent, or Firm*—Baker & Botts, L.L.P.

[57] ABSTRACT

A multi-layered type heat exchanger for a refrigerant fluid circuit is disclosed which includes a plurality of substantially parallel flat tubes. Each flat tube includes a partition wall for dividing its interior into two fluid passages. A plurality of fin units are disposed between the plurality of flat tubes. A header pipe has a plurality of slits for inserting upper ends of the flat tubes, respectively, and at least one partition wall to divide the interior thereof into at least two chambers. A seal member sealingly closes lower open ends of the flat tubes. Thus, since the height and length of the flat tubes can be easily adjusted, various sizes and designs of heat exchangers can be easily and cost effectively produced.

2 Claims, 9 Drawing Sheets

MULTI-LAYERED TYPE HEAT EXCHANGER

FIELD OF THE INVENTION

The present invention relates to a heat exchanger, and more particularly, to a heat exchanger for use in an automotive air-conditioning system.

DESCRIPTION OF THE PRIOR ART

A conventional multi-layered type evaporator or heat exchanger is described in Japanese Patent Application Laid-Open Gazette No. 61-217697 and depicted in FIGS. 14–16, of this application. This conventional heat exchanger has a plurality of substantially parallel flat tubes 10 each formed by two press-worked core plates 1 sealingly joined together. Each flat tube 10 includes a pair of tank portions spaced widthwise of the flat tube 10 and formed by protrusions 2, 3 formed in one end of each of the two core plates 1. Protrusions 2 and 3, which protrude laterally outwardly of flat tube 10, define holes providing inlet ports for a heat transfer fluid. Thus, each flat tube 10 defines therein a passage for the heat transfer fluid. This passage communicates at opposite ends with the tank portions 50 such that the heat transfer fluid flows from one tank portion into the passage towards the other end of flat 10, and then through the other tank portion.

Flat tubes 10 are successively stacked by interconnecting or abutting protrusions 2, 3 on adjacent core plates 1. The outermost core plates 1 form the ends of the heat exchanger and provide inlet and outlet ports for the heat exchange fluid. Abutting core plates 1 of an adjacent flat tubes 10 are sealingly connected with each other. Adjacent core plates 1 of each adjacent pair of flat tubes 10 have bent end portions which extend towards and are engaged with each other or integrally connected together to support, in spaced relationship, the other ends of adjacent flat tubes 10.

A primary disadvantage of this above heat exchanger is the high cost of molds for forming core plates, making it impractical to use various molds for forming various core plates. Although few problems arise in designing the length or depth of a heat exchanger constituted by core plates, there are limits on designing the height if such a heat exchanger because of practical limits on the length of flat tubes 10. Likewise it is impractical to design an appropriate size of heat exchanger to satisfy various design criteria and production quantities because production costs of molds for forming core plates for the above-mentioned multi-layered type heat exchanger significantly increases.

SUMMARY OF THE INVENTION

It is a primary object of this invention to provide a multi-layered type heat exchanger which can be easily and cost effectively produced in various designs and sizes and which can be produced in various quantities on a cost effective basis.

A multi-layered type heat exchanger for a refrigerant fluid circuit according to the present invention includes a plurality of substantially parallel flat tubes. Each flat tube includes a partition wall for dividing its interior into two fluid passages. A plurality of fin units are disposed between the plurality of flat tubes. A header pipe has a plurality of slits for inserting the upper ends of the flat tubes, respectively, and at least one partition wall to divide the interior thereof into at least two chambers. A seal member sealingly closes the lower ends of the flat tubes.

Further objects, features and aspects of this invention will be understood from the following detailed description of the preferred embodiments of this invention with reference to the accompanying drawings.

BRIEF DESCRIPTION OF THE DRAWINGS

FIG. 2(*b*) is another plane view of a flat tube incorporated in the heat exchanger as shown in FIG. 1.

FIG. 5(*b*) is a front elevational view of flat tube shown in FIG. 5(*a*).

FIG. 7(*b*) is a front elevational view of the flat tube shown in FIG. 7(*a*).

FIG. 9(*b*) is a front elevational view of the flat tube shown in FIG. 9(*a*).

FIG. 11(*b*) is a front elevational view of the plate-shaped inner fin shown in FIG. 11(*a*).

FIG. 12(*b*) is front elevational view of the seal member shown in FIG. 12(*a*).

DESCRIPTION OF THE PREFERRED EMBODIMENT

Figure 1:
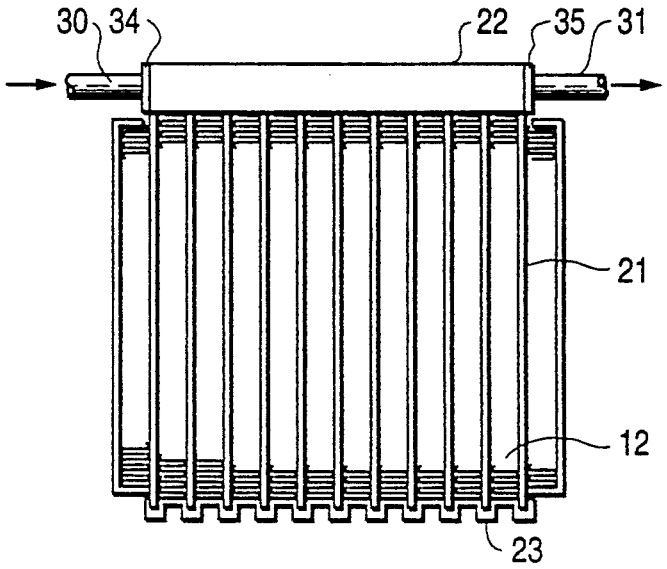
FIG. 1 is a front elevational view of a heat exchanger in accordance with a first embodiment of this invention.
Figure 2A:
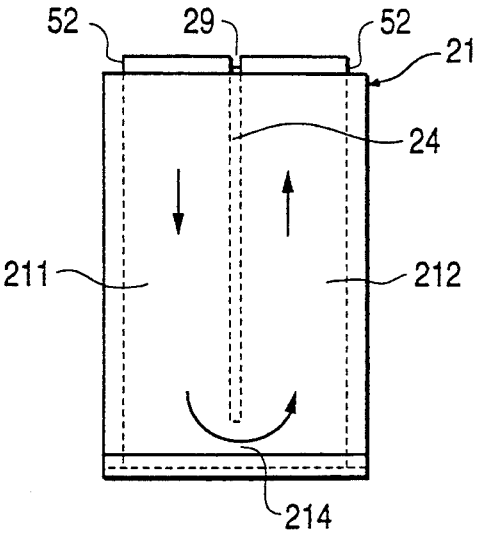
FIG. 2(*a*) is a plane view of a flat tube incorporated in the heat exchanger as shown in FIG. 1.
Figure 2B:
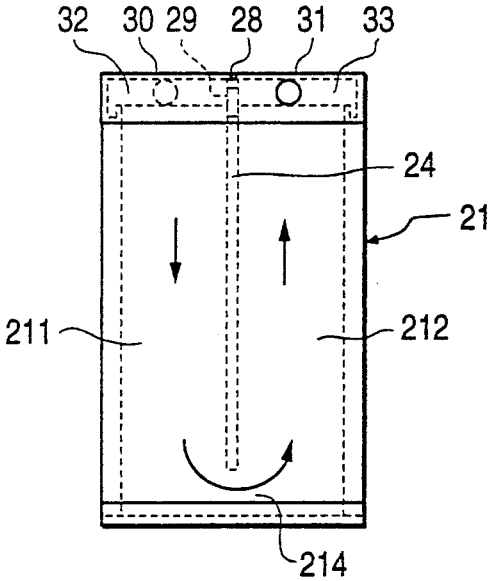
Figure 3:
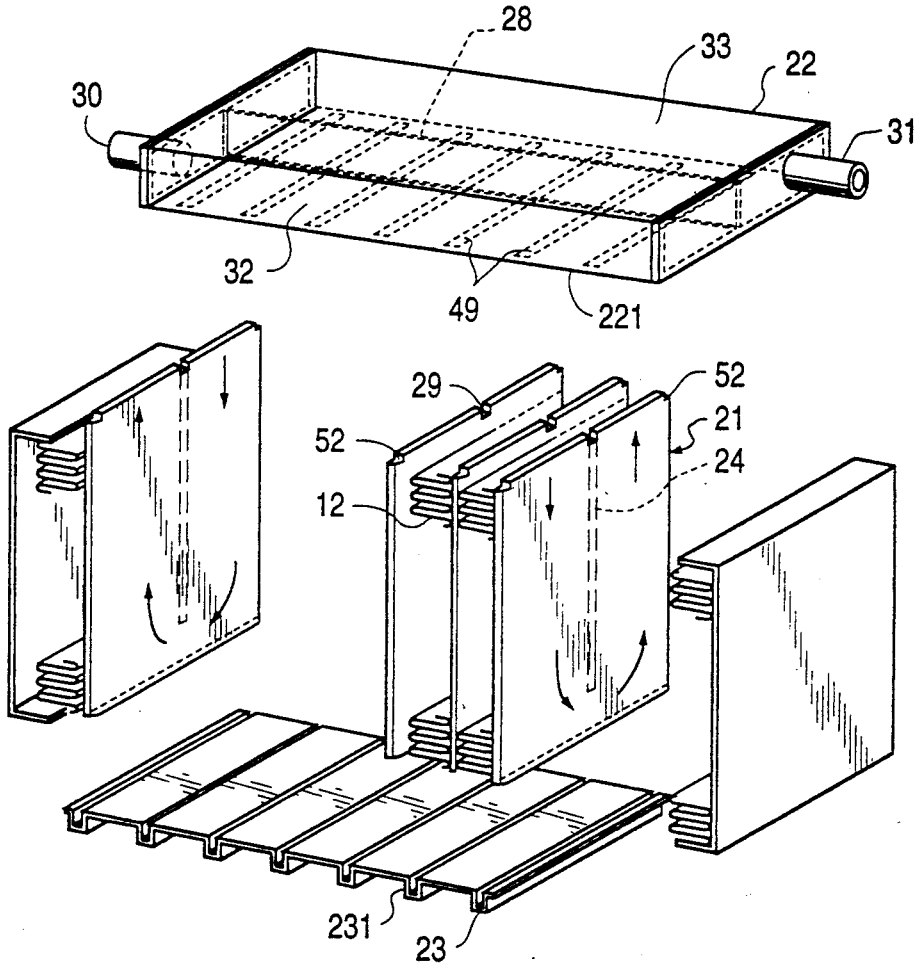
FIG. 3 is an exploded perspective view of the heat exchanger shown in FIG. 1.

Construction of a heat exchanger for use in an automotive air conditioning refrigerant circuit in accordance with one embodiment of this invention is shown in FIGS. 1 to 3. The heat exchanger includes a plurality of flat tubes 21, corrugated fins 12 disposed between flat tubes 21, seal plate 23 and rectangular header pipe 22. Rectangular header pipe 22 is located at the open end of flat tubes 21, and seal plate 23 is located at the opposite end.

Each flat tube 21 is divided into two fluid passages 211 and 212 by partition wall 24. Partition wall 24 extends from the upper end of flat tube 21 to an area adjacent the lower end. U-shaped cut-out portion 29 is formed at the center of the upper end of flat tube 21. Cut-out partitions 52 are formed on both sides of the upper end of the flat tubes 21. Since the distance between the lower end of partition wall 24 and the interior surface of seal plate 23 forms U-shaped passage 214, fluid can flow from fluid passage 211 to fluid passage 212 through U-shaped passage 214.

Rectangular header pipe 22 includes a plurality of longitudinal slits 49, formed on bottom plate 221 thereof, into which the upper end of each flat 21 is inserted. Partition wall 28 extends in the longitudinal direction to divide the interior of rectangular header pipe 22 into front and rear chambers 32 and 33. Inlet port 30 is connected to rectangular header pipe 22 to communicate with front chamber 32 and outlet port 31 is connected to rectangular header pipe 22 to communicate with rear chamber 33. Seal plate 23 includes a plurality of grooves 231 aligned parallel each other with a certain interval therebetween to correspond to the lower end of each flat 21.

As shown in FIG. 3, when rectangular header pipe 22 is connected to each flat tubes 21, the upper end of each flat tube 21 is inserted into one of each longitudinal slits 49. Simultaneously, partition wall 28 is inserted into U-shaped cut-out portions 29 formed on the upper end of each flat tube 21. The lower end portion of each flat tube 21 is inserted into one of grooves 231 of seal plate 23. Fluid then is introduced into front chamber 32 of rectangular header pipe 22 through inlet port 30 and flows into flat tubes 21. The fluid in flat tubes 21 flows through fluid passage 211, U-shaped passage 214 and fluid passage 212 into rear chamber 33 of rectangular header pipe 22, and then flows out outlet port 31.

Figure 4:
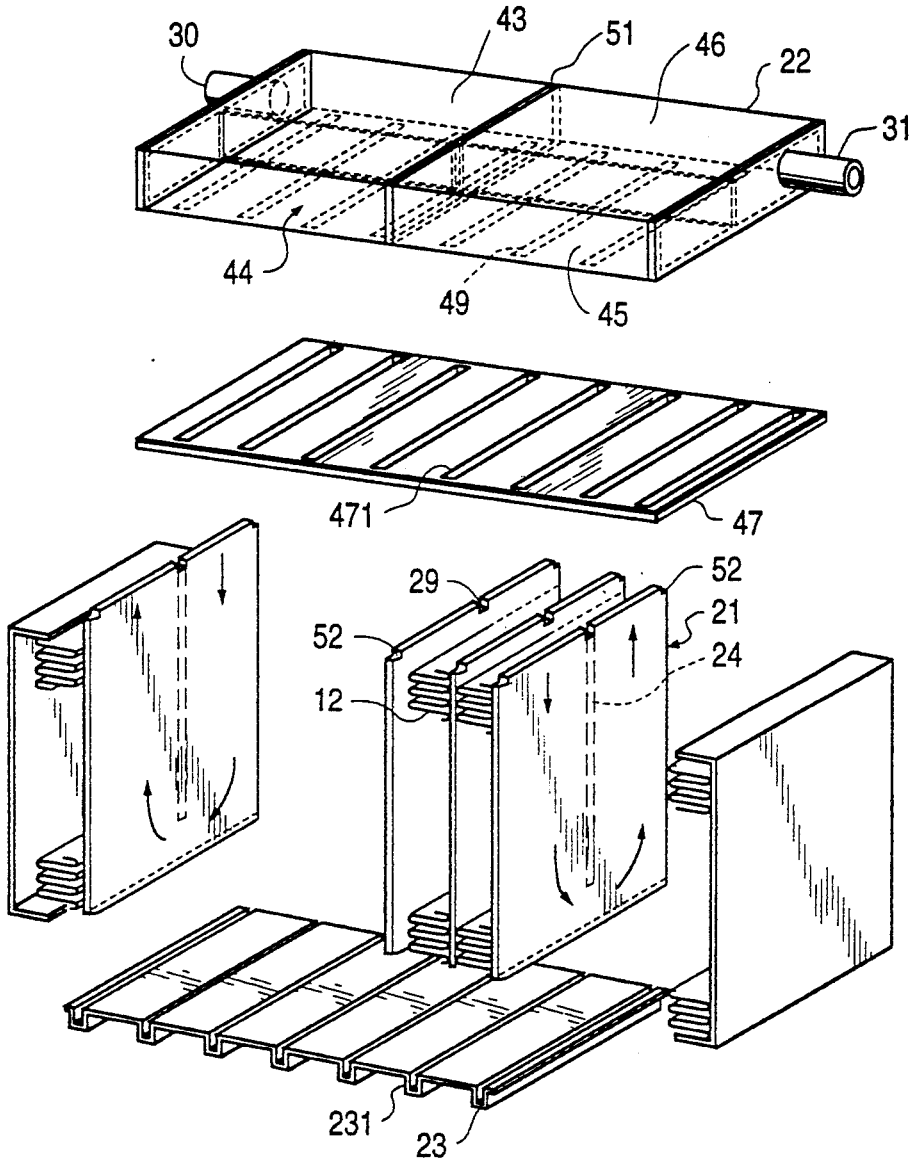
FIG. 4 is an exploded perspective view of heat exchanger in accordance with a second embodiment of this invention.

Referring to FIG. 4, the construction of the heat exchanger in accordance with a second embodiment of this invention is shown. Like parts in the first and second embodiments are described by the same reference numerals. Accordingly, the description of such parts is omitted to simplify the specification.

Rectangular header pipe 22 includes partition wall 28 extending in the longitudinal direction to divide the interior of rectangular header pipe 22 into front and rear chambers. Additionally, partition wall 51 extends in the lateral direction to divide the interior of rectangular header pipe 22 into left and right chambers. Accordingly, the interior of rectangular header pipe 22 is divided into four chamber, i.e., first chamber 43, second chamber 44, third chamber 45 and fourth chamber 46, by partition walls 28 and 51. Inlet port 30 is connected to rectangular header pipe 22 in communication with first chamber 43. Outlet port 31 is connected to rectangular pipe 22 in communication with fourth chamber 46.

In the present embodiment, brazing sheet 47 is disposed between rectangular header pipe 22 and each flat tube 21. When rectangular header pipe 22 is connected to each flat tube 21, the upper end of each flat tube 21 is inserted into longitudinal slits 49 through longitudinal slits 471 formed on brazing plate 47. Brazing plates 47 is used because, in this embodiment, rectangular header pipe 22 is made by a extrusion process. On the other hand, if an electric-resistance weld pipe which includes brazing material clad one or both ends are used, brazing plate 47 can be omitted.

Figure 5A:
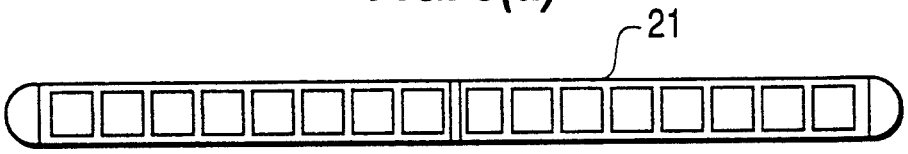
FIG. 5(*a*) is a top plane view of another flat tube.
Figure 5B:
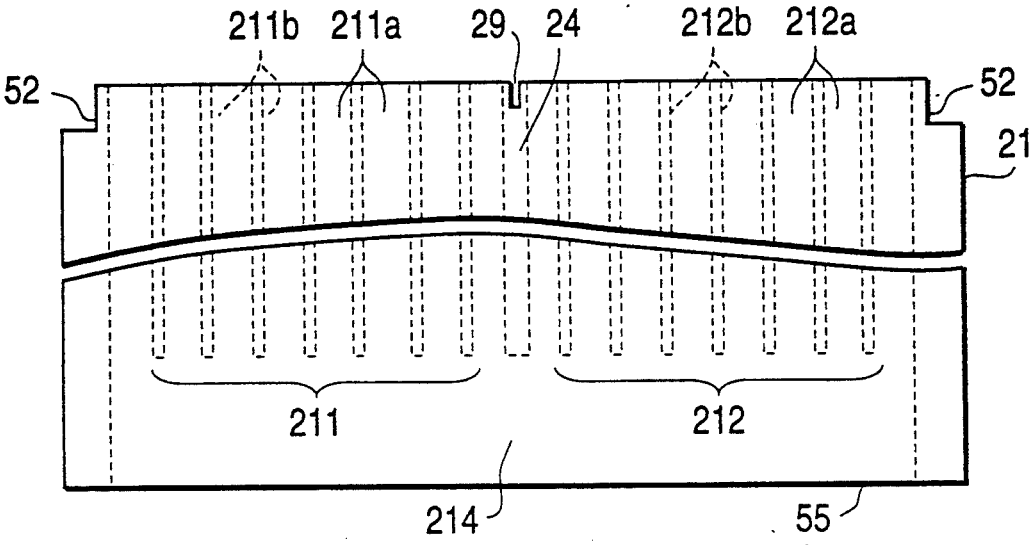

Referring to FIGS. 5(*a*) and 5(*b*), the construction of flat tubes 21 in accordance with a third embodiment of this invention is shown. Flat tubes 21 are formed by a extrusion process. Fluid passages 211 and 212 are further divided into a plurality of small fluid passages 211(*a*) and 212(*a*) by a plurality of partition walls 211(*b*) and 212(*b*). The length of partition walls 211(*b*) and 212(*b*) is the same as that of partition wall 24. Thus, U-shaped passage 214 is formed as in the first embodiment of this invention.

Figure 6:
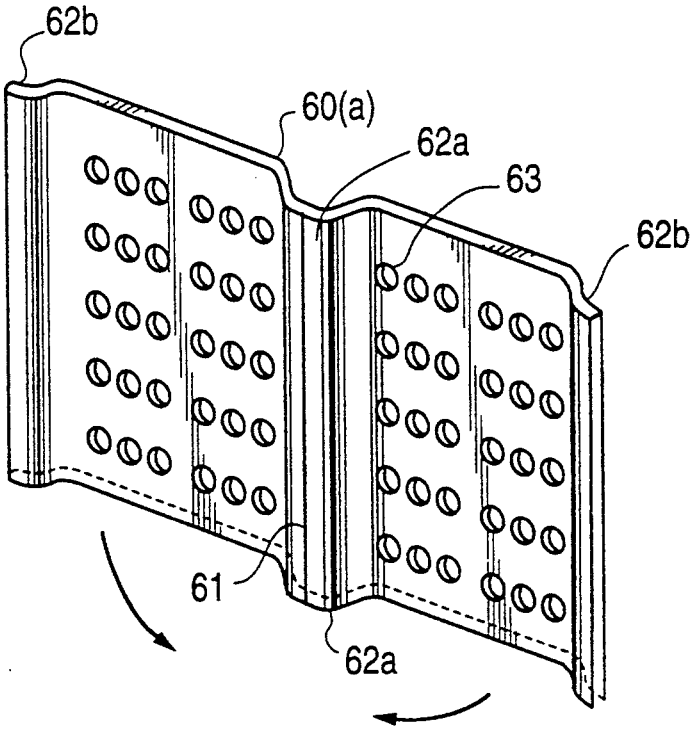
FIG. 6 is a perspective view of still another flat tube before assembly.
Figure 7A:
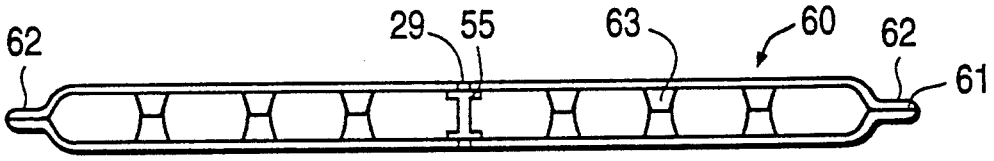
FIG. 7(*a*) is a top plane view of the flat tube shown in FIG. 6.
Figure 7B:
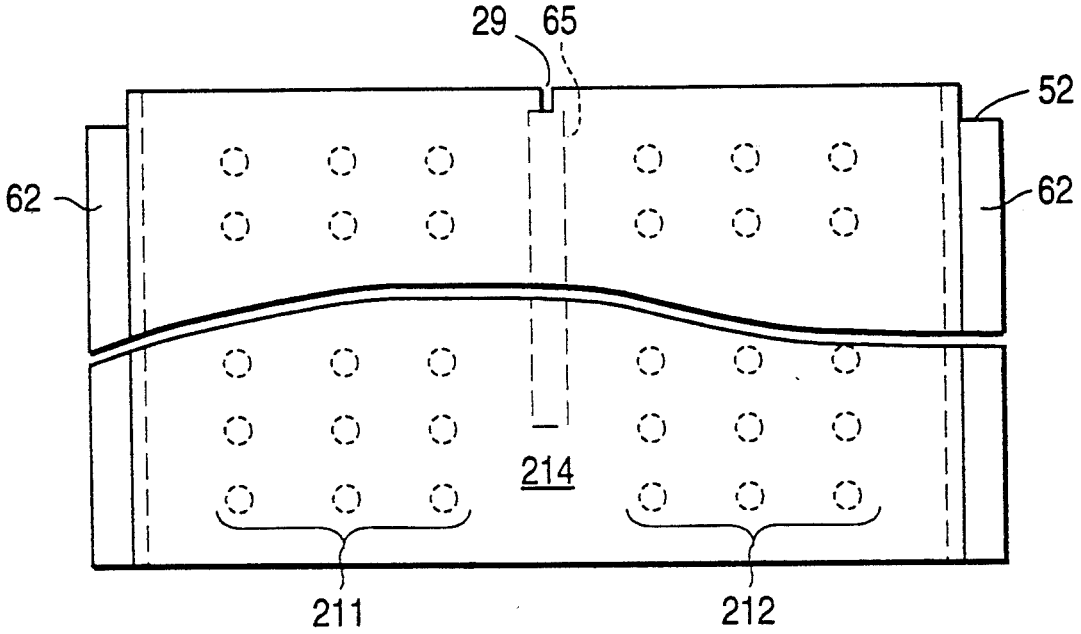

Referring to FIGS. 6, 7(*a*) and 7(*b*) the construction of a heat exchanger in accordance with a fourth embodiment of this invention is shown. Flat tube 60 is made from bendable plate 60(*a*) which includes brazing material clad at one or both ends. Plate 60(*a*) includes protruding outer-edge portions 62(*a*) and 62(*b*). Folding line 61 extends along the center of outer edge portion 62(*a*). A plurality of projections 63 are formed on the surface of plate 60(*a*) having brazing material at their ends. Plate 60(*a*) is bent along folding line 61 so that projections 63 contact each other and outer-edge portions 62(*a*) and 62(*b*) contact each other as shown in FIG. 7(*a*). Cut-out portion 29 is formed on the upper edge of flat tube 60. Partition wall 65 is inserted into the interior of flat tube 60 at its center for the reasons described in the previous embodiments. Thus, fluid passages 211 and 212 and U-shaped passage 214 are formed as described in the previous embodiments.

The contact surfaces of projections 63, outer-edge partitions 62(*a*) and 62(*b*) and partition wall 65 are finally and simultaneously attached by a single brazing process upon connection of flat tubes 60 to rectangular header pipe 22 and seal plate 23. In the embodiment of FIGS. 6–7, although the end portions of projections 63 are connected to each other, the end portions of one set of projections could be connected to planar portions of plate 60(*a*).

Figure 8:
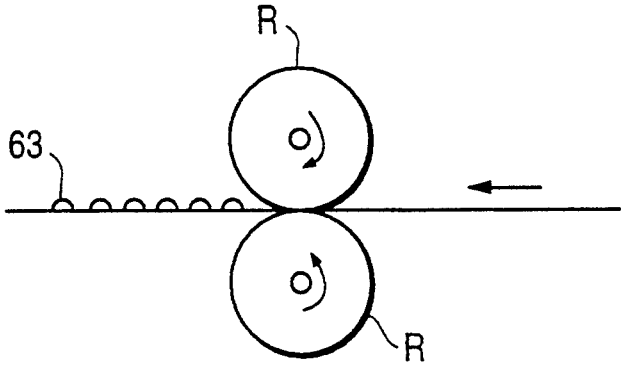
FIG. 8 is a side view of a plate and roller showing a method for manufacturing projection on the flat tube shown in FIG. 6.

Projection 63 of plate 60(*a*) can be formed by a rolling process as shown FIG. 8. A planar plate can be inserted between a pair of rollers R to form projections 63 upon rotation of rolls R.

Figure 9A:
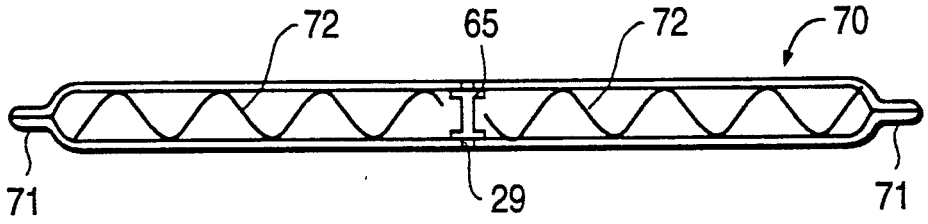
FIG. 9(*a*) is a top plane view of still another flat tube.
Figure 9B:
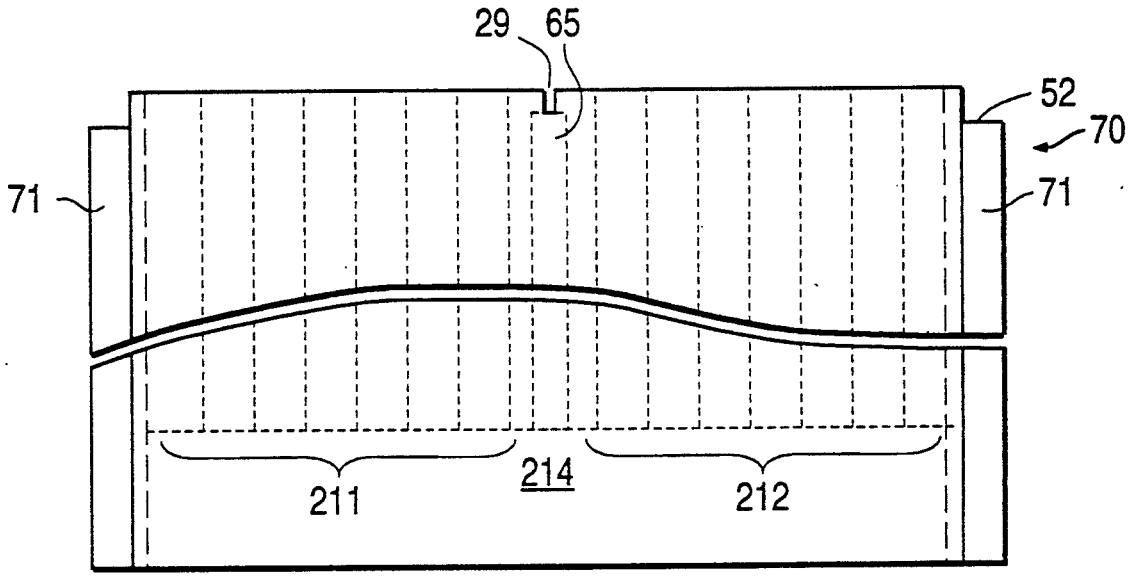

Referring to FIGS. 9(*a*) and 9(*b*), the construction of a flat tube for a heat exchanger in accordance with a fifth embodiment of this invention is shown. Flat tube 70 is made from an electric-resistance weld pipe with brazing material clad at both ends. Outer-edge portions 71 at both sides of flat tube 70 engage each other through a pressing process. Partition wall 65 is inserted into the interior of flat tube 70. Fluid passages 211 and 212 are defined by partition wall 65. Wave-shaped inner fins 72 are inserted into fluid passages 211 and 212, respectively, and are fastened to the inner surface of flat tube 70 by a brazing process. In the above described flat tube, it is unnecessary to use a clad material for manufacturing the tube. Such a flat tube can be made by a protrusion process provided wave-shaped inner fins 72 and partition wall 65 are made of clad material.

Figure 10:
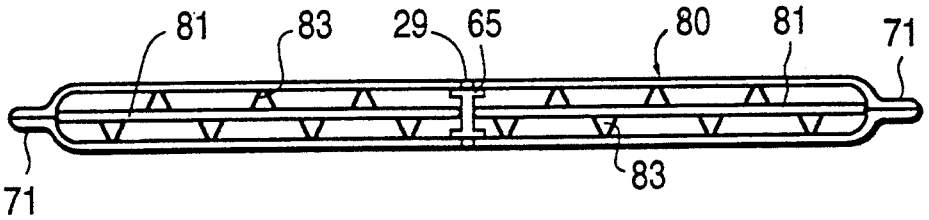
FIG. 10 is a front elevational view of still another flat tube.
Figure 11A:
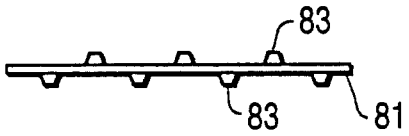
FIG. 11(*a*) is a top plane view of a plate-shaped inner fin as shown in FIG. 10.
Figure 11B:
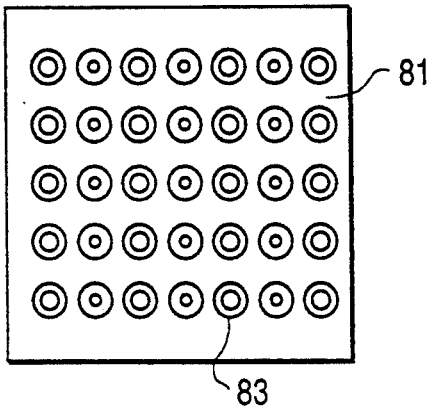

Referring to FIGS. 10, 11(*a*) and 11(*b*), the construction of another type of inner fin for use in the heat exchanger of the fifth embodiment of this invention is shown. Plate-shaped inner fins 81 are inserted into the interior of flat tube 80. Plate-shaped inner fins 81 have a plurality of projections 83 on both sides. Projections 83 perform the same function as projections 63 in the fourth embodiment. The end portions of projections 83 contact inner surfaces of flat tube 80 and are brazed thereto as previously described in the fifth embodiment. Projections 83 can be formed on plate-shaped inner fins 81 by the same method described in the fourth embodiment.

Figure 12A:
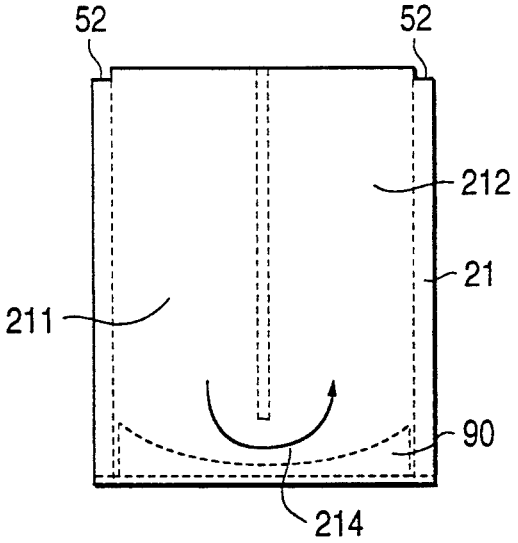
FIG. 12(*a*) is a front elevational view of a flat tube including an alternative embodiment of a seal member.
Figure 12B:
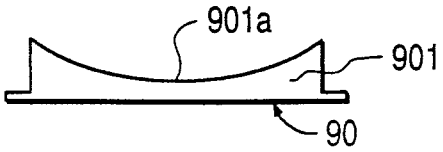

Referring to FIGS. 12(*a*) and 12(*b*), the construction of an alternative embodiment of a seal member is shown. Seal member 90 includes projection 901 extending toward the interior of flat tube 21. Inner surface 901(*a*) of projection 901 has a curved or U-shape. When fluid flows from fluid passage 211 to fluid passage 212 through U-shaped passage 214, the fluid flows more smoothly through passage 214 because of the curves shape of inner surface 901(*a*) of projection 901.

Figure 13A:
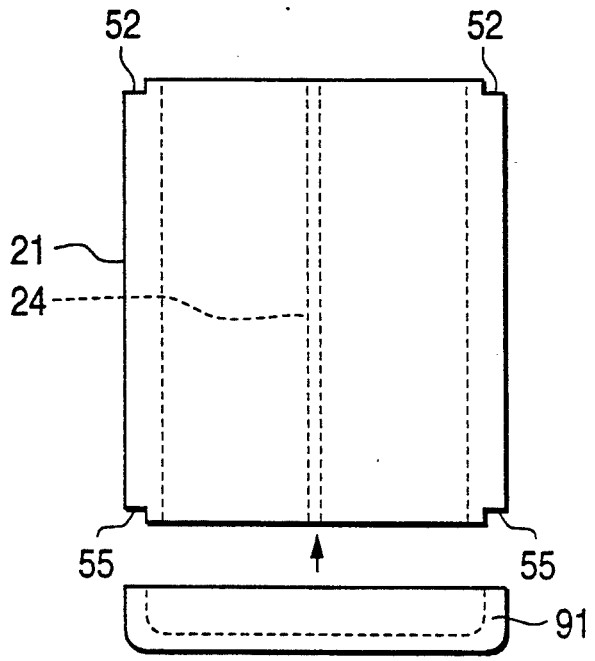
FIG. 13(*a*) and 13(*b*) are front elevational views of another alternative embodiment of a seal member.
Figure 13B:
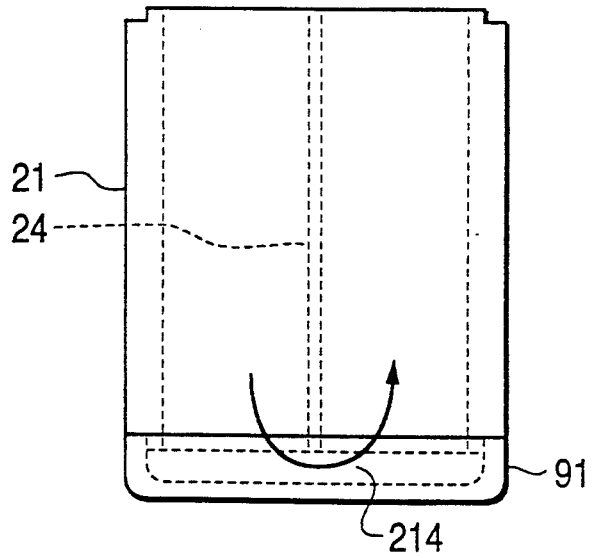
Figure 14:
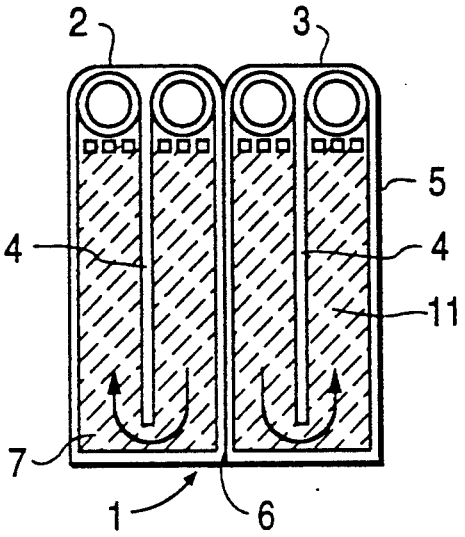
FIG. 14 PRIOR ART
FIG. 14 is a front elevational view of a prior art core plate.
Figure 15:
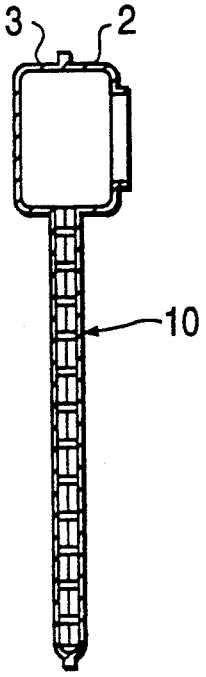
FIG. 15 PRIOR ART
FIG. 15 is a side view of the prior art core plate shown in FIG. 14.
Figure 16:
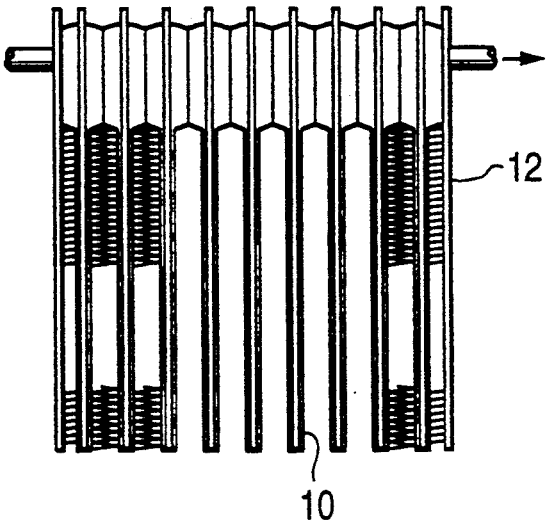
FIG. 16 PRIOR ART
FIG. 16 is a front elevational view of a prior art heat exchanger.

Referring to FIGS. 13(*a*) and 13(*b*), the construction of a seal member in accordance with another embodiment of the invention is shown. Flat tube 21 includes partition wall 24 extending from its upper end to its lower end. Tube 21 further includes cut-out portions 52 and 55 formed at its four corners. Cap-shaped seal 91 is fixedly disposed over cut-out portions 55 to cover the lower end of flat tube 21. Thus, U-shaped passage 214 is defined by the interior surface of cap-shaped seal member 91.

This invention has been described in detail in connection with the preferred embodiments. These embodiments are exemplary only, and the invention is not restricted thereto. It will be easily understood by those skilled in the art that other variations and modifications can easily be made within the scope of this invention, as defined in the appended claims.

I claim:

1. A multi-layered type heat exchanger for a refrigerant circuit comprising:

a plurality of substantially parallel flat tubes;

a partition wall mounted in each flat tube for dividing its interior into two fluid passages;

a plurality of fin units disposed between said plurality of flat tubes;

a header pipe having a plurality of slits for receiving first ends of said flat tubes;

at least one partition wall mounted within said header pipe to divide the interior thereof into at least two chambers, said chambers being in fluid communication with different ones of said fluid passages in each of said flat tubes; and sealing means mounted on second ends of said flat tubes for sealing the second ends of said flat tubes so that refrigerant fluid flows from one of said chambers of said header pipe to one of said fluid passages in each of said flat tubes to the other of said fluid passages to the other of said chambers in said header pipe wherein said sealing means comprises a plurality of seal members each having a curved shape projection for facilitating flow of a refrigerant fluid.

2. A multi-layered type heat exchanger for a refrigerant circuit comprising:

a plurality of substantially parallel flat tubes;

a partition wall mounted in each flat tube for dividing its interior into two fluid passages;

a plurality of fin units disposed between said plurality of flat tubes;

a header pipe having a plurality of slits for receiving first ends of said flat tubes;

at least one partition wall mounted within said header pipe to divide the interior thereof into at least two chambers, said chambers being in fluid communication with different ones of said fluid passages in each of said flat tubes; and sealing means mounted on second ends of said flat tubes for sealing the second ends of said flat tubes so that refrigerant fluid flows from one of said chambers of said header pipe to one of said fluid passages in each of said flat tubes to the other of said fluid passages to the other of said chambers in said header pipe wherein said sealing means comprises a plurality of cap-shaped seal members.

* * * * *